US007546703B2

(12) United States Patent
Johnske et al.

(10) Patent No.: US 7,546,703 B2
(45) Date of Patent: Jun. 16, 2009

(54) FLIP-UP HEADERS FOR POINT-OF-PURCHASE DISPLAYS

(75) Inventors: David A. Johnske, Bolingbrook, IL (US); Renee Richardson, Sun Valley, CA (US)

(73) Assignees: Smurfit-Stone Container Corporation, Chicago, IL (US); Disney Enterprises, Inc., Burbank, CA (US)

( * ) Notice: Subject to any disclaimer, the term of this patent is extended or adjusted under 35 U.S.C. 154(b) by 349 days.

(21) Appl. No.: 11/439,683

(22) Filed: May 24, 2006

(65) Prior Publication Data

US 2007/0283606 A1 Dec. 13, 2007

(51) Int. Cl.
*G09F 1/08* (2006.01)

(52) U.S. Cl. ..... 40/539; 40/610; 206/736; 206/768

(58) Field of Classification Search ..... 40/611.13, 40/539, 606.01, 611.06, 610; 206/736, 768; 211/132.1, 149; 229/102.5; 248/174; 446/118, 446/108, 109
See application file for complete search history.

(56) References Cited

U.S. PATENT DOCUMENTS 890,135 A * 6/1908 Gilliland ..... 446/148
3,567,014 A 3/1971 Feigelman
3,656,611 A 4/1972 Mertz
3,692,174 A 9/1972 Ross
3,755,944 A 9/1973 Kaulfuss et al.
3,757,934 A 9/1973 Taub
3,799,332 A 3/1974 Jeronimus
3,918,576 A 11/1975 Taub
4,148,427 A 4/1979 Baker
4,164,287 A 8/1979 Muller et al.
4,191,288 A 3/1980 Hostad
4,274,613 A 6/1981 Taub
4,382,504 A 5/1983 Vesborg
4,384,651 A 5/1983 Smith
4,519,319 A 5/1985 Howlett
4,567,981 A 2/1986 Headon
4,579,220 A 4/1986 Brundage
4,605,130 A * 8/1986 Taub ..... 211/59.2
4,646,922 A * 3/1987 Smith ..... 211/186
4,784,277 A 11/1988 Wallish et al.
4,809,847 A 3/1989 Schneider
4,813,536 A 3/1989 Willis
4,919,270 A 4/1990 Govang et al.
4,938,343 A 7/1990 Willis
4,947,985 A 8/1990 Crabtree et al.
5,016,545 A 5/1991 Robertson et al.
5,042,651 A 8/1991 Davis et al.
5,251,753 A 10/1993 Pigott et al.
5,259,578 A 11/1993 Jones et al.
5,513,745 A 5/1996 Zoltan et al.

(Continued)

FOREIGN PATENT DOCUMENTS

DE 34 11 491 A1 10/1985

*Primary Examiner*—Gary C Hoge
(74) *Attorney, Agent, or Firm*—Greenberg Traurig LLP

(57) ABSTRACT

A three-dimensional display header for point-of-purchase displays is provided, which is pivotably movable from a stowed, flattened position atop a display topper, to a deployed, three-dimensional upright display position. In a first embodiment, the display header has a U-shaped configuration in its deployed position, while in a second embodiment, it has a box-shaped configuration in its deployed position.

17 Claims, 10 Drawing Sheets

U.S. PATENT DOCUMENTS 5,540,335 A 7/1996 Friedman
5,547,073 A 8/1996 Smith
5,630,518 A 5/1997 Collins
5,697,505 A 12/1997 Sprague
5,706,597 A 1/1998 Brandstetter
5,762,203 A 6/1998 Klawiter et al.
5,896,995 A 4/1999 Murray et al.
5,899,345 A 5/1999 Fuller et al.
6,038,797 A 3/2000 Smith
6,098,820 A 8/2000 Smith
6,105,796 A * 8/2000 Buchanan et al. ..... 211/128.1
6,158,579 A 12/2000 Rosenbaum
6,267,255 B1 7/2001 Brush
6,293,405 B1 9/2001 Burch, Jr.
6,386,371 B1 5/2002 Parsons
6,454,107 B1 9/2002 Belanger et al.
6,488,245 B1 12/2002 Maglione
6,837,378 B2 1/2005 Mason et al.
6,837,379 B2 1/2005 Dennis et al.
6,886,737 B2 5/2005 Dye
6,929,133 B1 8/2005 Knapp, III et al.
6,942,113 B1 9/2005 Johnske et al.
2004/0011753 A1 * 1/2004 Field et al. ..... 211/132.1

* cited by examiner

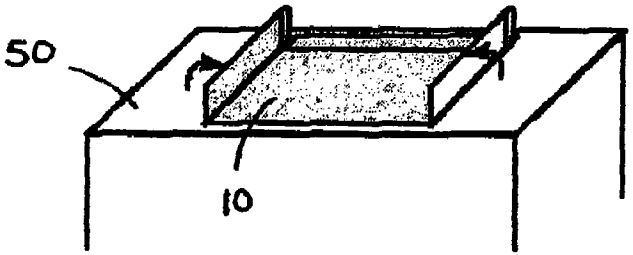
FIG. 5A. FOLD SIDE PANELS OF HEADER UPWARD.
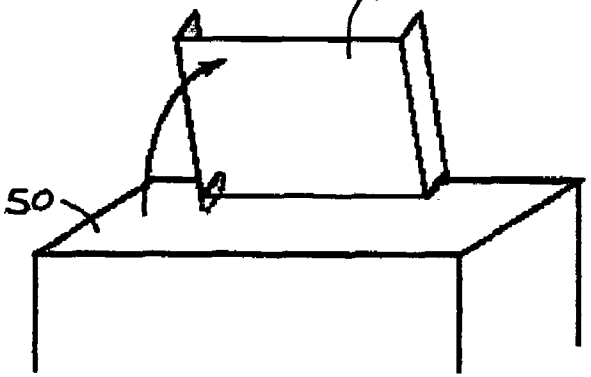
FIG. 5B. PIVOT HEADER UP WHILE GUIDING BOTTOM TABS INTO SLOTS.
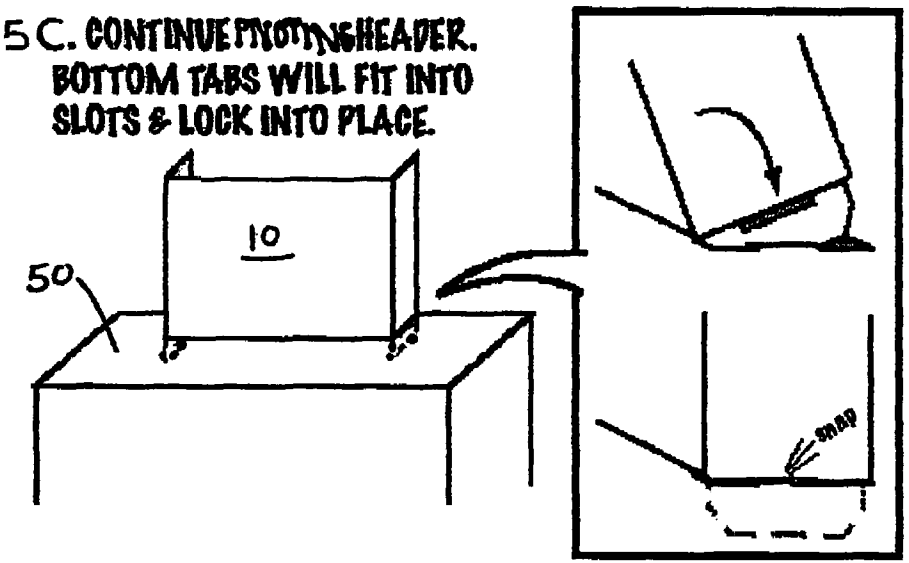
FIG. 5C. CONTINUE PIVOTING HEADER. BOTTOM TABS WILL FIT INTO SLOTS & LOCK INTO PLACE.
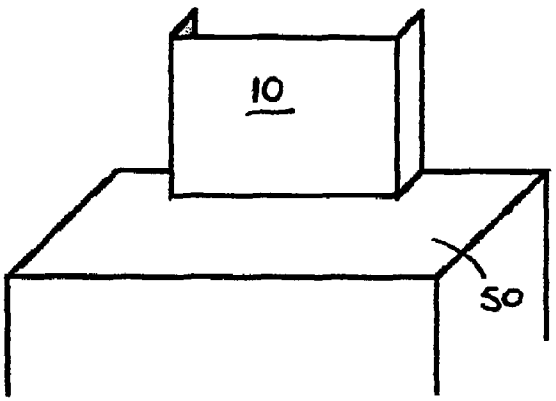
FIG. 5D. COMPLETED HEADER STANDS UPRIGHT.

FLIP-UP HEADERS FOR POINT-OF-PURCHASE DISPLAYS

BACKGROUND OF THE INVENTION

1. The Technical Field

The present invention relates to point-of-purchase displays, typically fabricated from corrugated paperboard material, particularly such displays which are reconfigurable from a shipping configuration to a display configuration. The present invention relates in particular to display headers for such point-of-purchase displays.

2. The Prior Art

Display headers for point-of-purchase displays are well known.

The simplest version of a display header is simply a flat panel that either extends as a mere continuation of a front or rear wall of a display, or as a glued-on extension. Sometimes, these headers are folded down, over the top or is front of the display, during shipment. Such header constructions may be seen in such references such as Jeronimus, U.S. Pat. No. 3,799,332; Taub, U.S. Pat. No. 4,274,613; and Vesborg, U.S. Pat. No. 4,382,504.

Other displays employ a header which is a separate sheet of planar material that is inserted onto a top edge of the main display, sometimes with interdigitating notches formed in one or both of the bottom edge of the header or a top edge of a wall of the display. Typically, the header is either inserted amongst the articles being shipped, or is laid atop the display, during shipment. Such header constructions may be seen in references such as Taub, U.S. Pat. No. 3,918,576; Baker, U.S. Pat. No. 4,148,427; and Hostad, U.S. Pat. No. 4,191,288, among others. Still other displays, such as those made and sold by Cameo Container Corporation, included a simple U-shaped header with a front wall and two side walls, with simple tabs extending downwardly from the side walls to be received by slots, typically in the side panels of the display itself, typically so that the front wall aligned with a front wall of the display, and the side walls aligned with side walls of the display. Yet other displays utilize folded or box-shaped headers that "pop-up" from a position within the display, as described in Feigelman, U.S. Pat. No. 3,567,014; Taub, U.S. Pat. No. 3,757,934; Mason et al, U.S. Pat. No. 6,837,378 B2; and Germany, DE 34 11 491.

These displays typically require several specific movements by a store worker in order for the header to be deployed. Further, many two-dimensional headers lack depth, rigidity, stability, profile and "presence".

It is thus desirable to provide a header construction for a point-of-purchase display which is three-dimensional when deployed.

It is also desirable to provide a header construction which is compact when it is in its shipping configuration, yet which maximizes a visual profile upon deployment.

It is further desirable to provide a header construction which is easily deployed from a stowed configuration, with a minimum amount of effort required by the installer.

Another advantage of the present invention is to provide a header construction which is highly stable when in its deployed configuration.

These and other desirable characteristics of the present invention will become apparent, in view of the specification, including the claims, and drawings.

SUMMARY OF THE INVENTION

The present invention comprises a three-dimensional display header, for a point-of-purchase display.

The display header comprises a central panel, for bearing display indicia. At least one side panel emanates from a first side edge of the central panel, for supporting the central panel. The at least one side panel is pivotable from a position substantially adjacent to the central panel, to a position substantially perpendicular to the central panel. At least one central panel tab emanates from a lower edge of the central panel, and is operably configured to be insertably and restrainably received in a first slot in a display topper of a point-of-purchase display. The at least one central panel tab enables the central panel to be pivotable from a stowed position substantially parallel to an upper surface of a display topper of a point-of-purchase display, to a display position substantially perpendicular to the upper surface of the display topper of said point-of-purchase display. At least one side panel tab emanates from a lower edge of the at least one side panel, and is operably configured to be insertably and restrainably received in a second slot in a display topper of the point-of-purchase display, upon positioning of the at least one side panel, in said position substantially perpendicular to the central panel, and upon positioning of the central panel in a position substantially perpendicular to the upper surface of the display topper of the point-of-purchase display.

The display header of the present invention is preferably, operably configured to be disposed on the point-of-purchase display, such that the central panel is disposed facing toward a front side of the point-of-purchase display, with the at least one side panel extending rearwardly from the first side edge of the central panel. The display header is preferably positioned proximate the rear edge region of the topper, and is operably configured to be folded downwardly, to a position overlying and adjacent to an upper surface of the topper, with no portions of the folded-down header extending beyond peripheral edge regions ("the footprint") of the topper.

The at least one side panel preferably comprises two side panels, each emanating from an opposing side edge of the central panel, and pivotable from a position substantially parallel to the central panel, to a position substantially perpendicular to the central panel.

The central panel preferably comprises two central panel layers joined to one another along adjacent respective top edge regions of the two central panel layers, and folded to overlying positions, parallel to and adhered to one another.

The at least one side panel preferably comprises two side panel layers joined to one another along adjacent respective top edge regions of the two side panel layers, and folded to overlying positions parallel to and adhered to one another.

The at least one central panel tab preferably has a width which is less than the length of the first slot in the display topper.

The at least one central panel tab preferably has a flap extending laterally therefrom, along a fold line, so that the total width of the at least one central panel tab and flap becomes greater than the length of the first slot in the display topper, whereupon folding of the flap back upon the at least one central panel tab, insertion of the at least one central panel tab into the first slot in the display topper is enabled, and after passage of the flap through the first slot, the tab is prompted (such as by fiber memory, or otherwise) to return toward an unfolded position, precluding removal of the at least one central panel tab from the first slot in the display topper.

The at least one side panel tab preferably has a width which is greater than the length of the second slot in the display topper, and includes a longitudinally forward-extending portion operably configured to be positioned, upon insertion of the at least one side panel tab into the second slot in the display topper. Preferably, the at least one side panel tab includes a beveled rear edge to facilitate rotatable insertion of the at least one side panel tab into the second slot of the display header, as the central panel pivotably rotates at the attachment position of the central panel slot.

The display header preferably further comprises a longitudinally extending slot disposed between the at least one side panel and the at least one side panel tab, which slot is operably configured to receive a longitudinally extending and horizontally projecting tab disposed in the second slot in the display topper, for retaining the at least one side panel tab in its inserted position, to, in turn, assist in retaining the display header in its display position substantially perpendicular to the display topper.

In an alternative embodiment of the invention, the display header preferably further comprises a rear panel, operably and pivotably connecting the two side panels, and disposed parallel to the central panel, so that upon positioning of the display header in its stowed position, the rear panel is positioned parallel to and partially overlying the central panel, with one side panel extending parallel to and away from the central panel, and the other side panel overlying a portion of and extending parallel to the central panel. Upon positioning of the display header in its display position, the side panels are perpendicular to the central panel and the rear panel, and parallel to each other.

In this alternative embodiment of the invention, the display header preferably further comprises a lid panel pivotably connected, along a first edge thereof, to an upper edge of the central panel, between a stowed position, extending parallel to and away from the central panel, and a display position extending perpendicular to and toward the rear panel. In this alternative embodiment, the display header preferably also further comprises a closure flap extending from a second edge of the lid panel, which closure flap is configured to be disposed adjacent an upper edge region of the rear panel, when the display header is in its display position, towards retaining the lid panel in its display position. This embodiment of display header preferably also further comprises a rear panel tab, operably configured to be received in a third slot disposed in a display topper, for facilitating retention of the display header in its display position. The rear panel is preferably connected to the side panels by interlocking slots and tabs disposed in the side panels and rear panel, respectively.

BRIEF DESCRIPTION OF THE DRAWINGS

FIGS. 5A-5D are a series of schematic illustrations of the header of FIGS. 1-3, in perspective view, showing how the header is folded and positioned on the top panel (display topper) of a shipper/display.

DETAILED DESCRIPTION OF THE INVENTION

Figure 1:
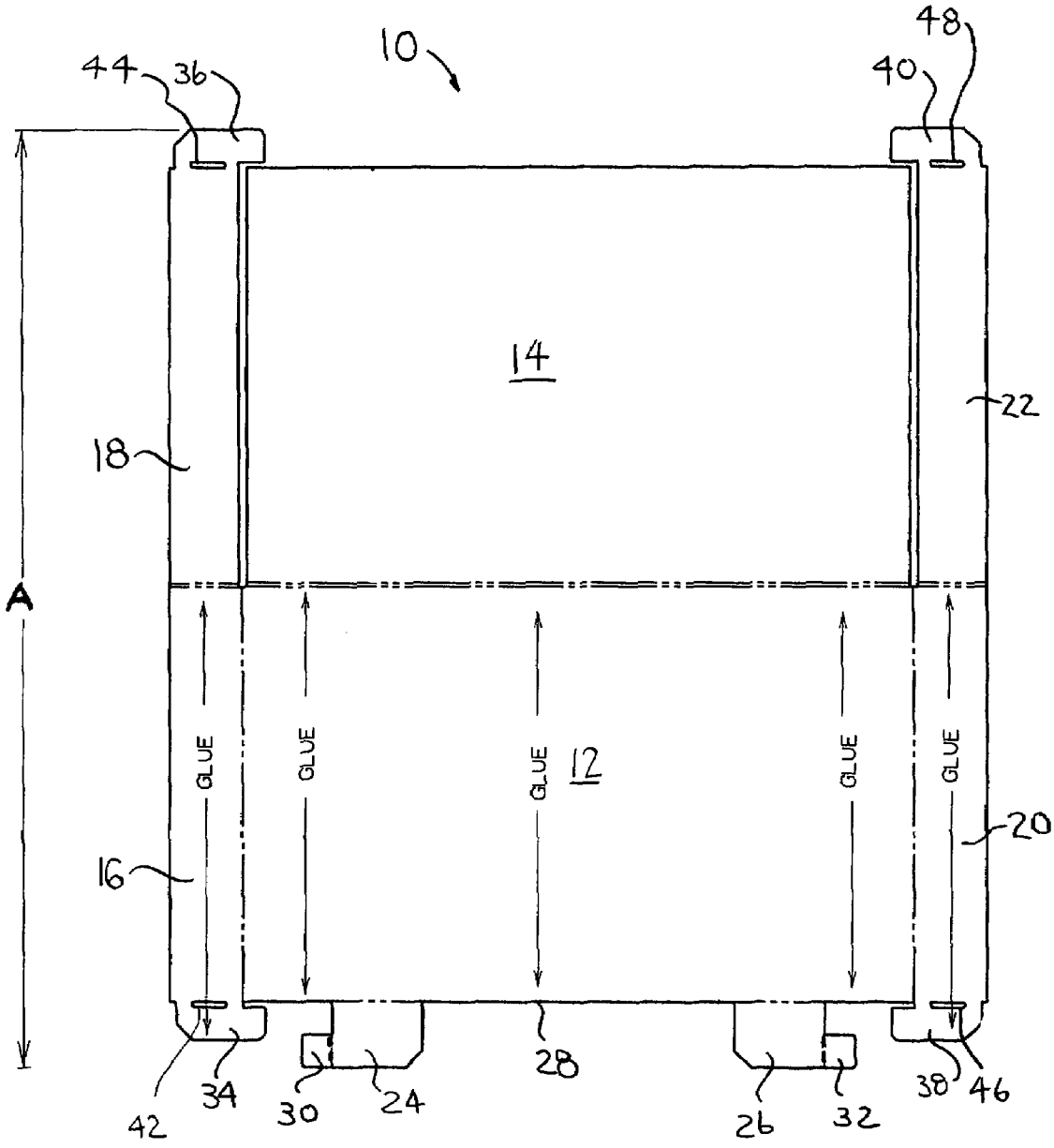
FIG. 1 is a plan view of a blank for a header according to a first preferred embodiment of the invention.

While this invention is susceptible of embodiment in many different forms, there is shown in the drawings and will herein be described in detail, several preferred embodiments of the invention, with the understanding that the present disclosure should be considered as an exemplification of the principles of the invention and is not intended to limit the invention to the embodiments so illustrated.

In accordance with the usual conventions regarding the illustration of blanks of foldable material, unless otherwise expressly indicated, solid lines within the interior of a blank represent through-cuts or apertures, and broken or dotted lines represent lines of weakness, such as score lines, perforations, or the like. In preferred embodiments of the invention, each of the blanks illustrated herein is fabricated from a corrugated paperboard material (preferably of the grade known in the industry as single-wall B-flute corrugated paperboard), although similar paper-based or other materials, both fibrous and/or plastic materials, having similar performance characteristics, may be employed if desired.

FIGS. 1-5 illustrate a flip-up display header according to a first embodiment of the present invention. FIG. 1 illustrates a plan view of blank 10 for forming a flip-up header having a U-shaped configuration when in its installed configuration. If blank 10 is fabricated from corrugated paperboard material, preferably, the corrugations run in the direction of arrow A. Blank 10 includes outer center panel 12, inner center panel 14, outer left panel 16, inner left panel 18, outer right panel 20, and inner right panel 22. Center panel tabs 24, 26 emanate from the lower edge 28 of outer center panel 12. Flaps 30, 32 are foldably connected to tabs 24, 26 along fold lines disposed therebetween. Tabs 34, 36, 38 and 40 extend from the "bottom" regions of outer left panel 16, inner left panel 18, outer right panel 20, and inner right panel 22, respectively, and are separated therefrom by elongated slots 42, 44, 46 and 48, respectively.

Figure 2:
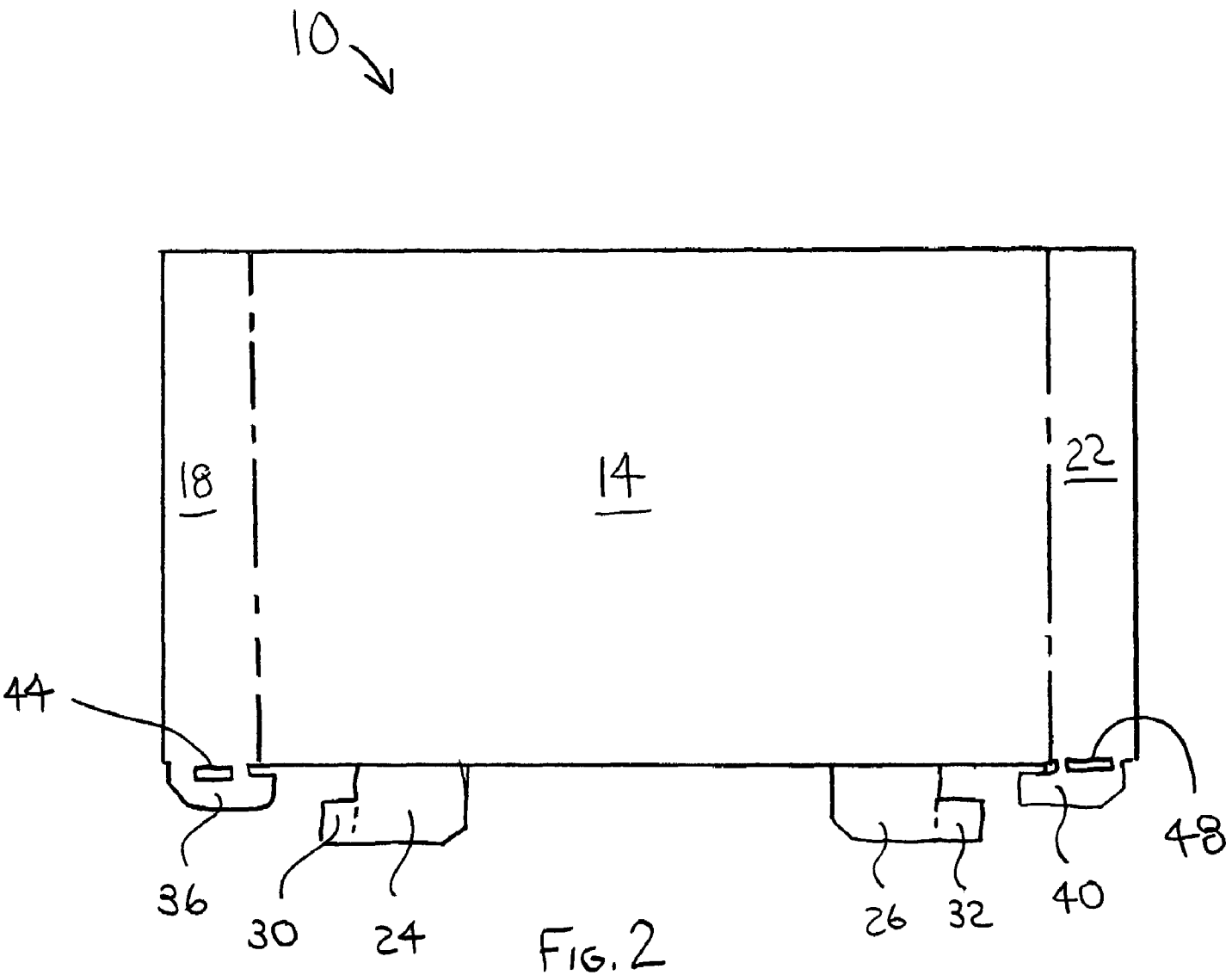
FIG. 2 is a plan view of the header of FIG. 1, after initial articulation and gluing.

In a preferred embodiment of the invention, panels 18, 14 and 22 are folded over (toward the observer of FIG. 1) and glued to panels 16, 12 and 20, respectively. The arrows marked "glue" indicate suggested lines for placement of the glue. Slots 44 and 48 will be aligned with slots 42, 46, respectively, and tabs 36, 48 will be aligned with and glued to tabs 34, 38, respectively. FIG. 2 illustrates header 10, after the blank has been glued and folded over. In practice, when header 10 is mounted onto a display, panel 14 will be facing toward the rear of the display, and panels 18 and 22 will be facing toward one another, and perpendicular to panel 18.

Figure 3:
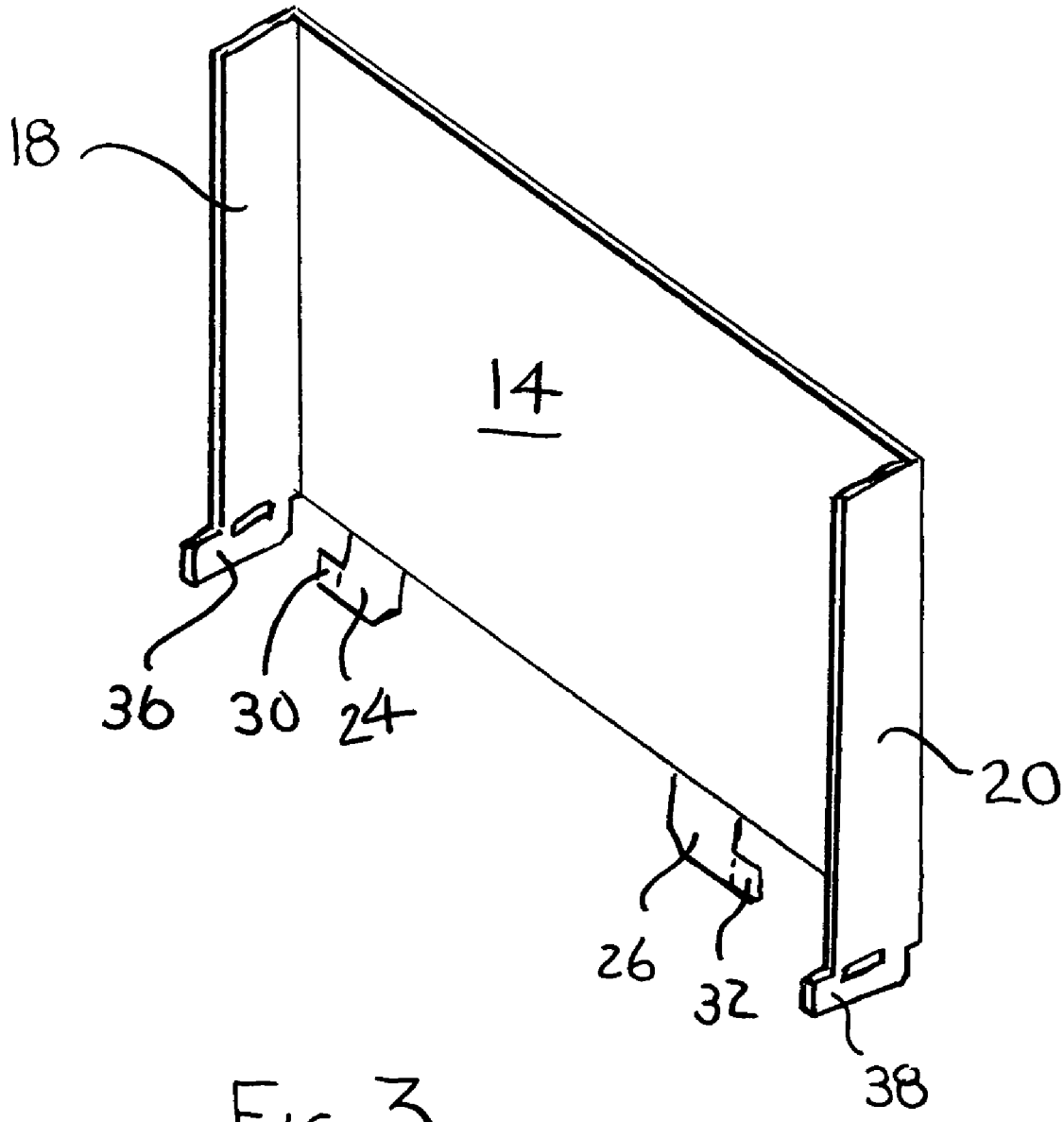
FIG. 3 is a perspective view of the header of FIGS. 1 and 2, after further articulation.
Figure 4:
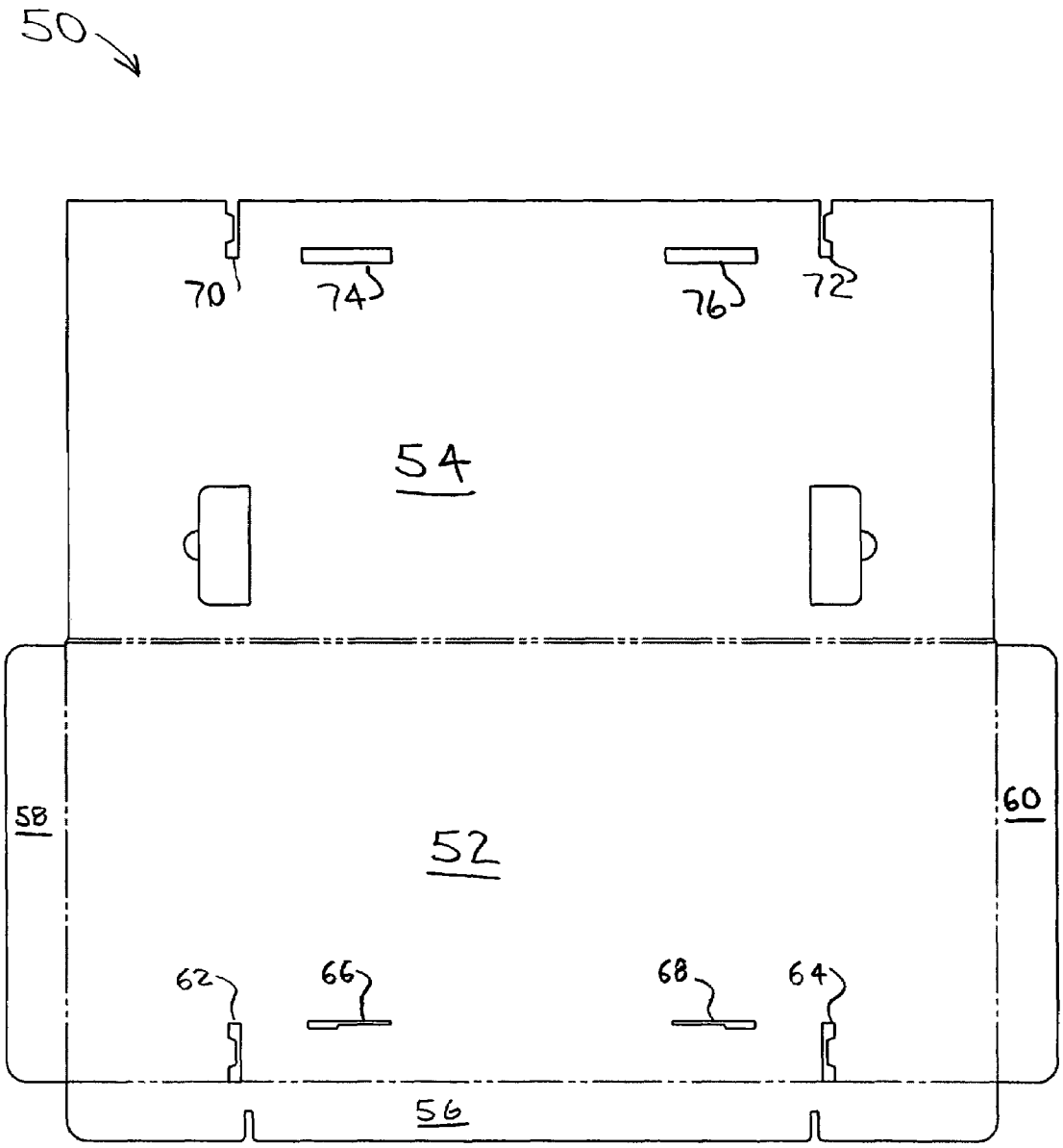
FIG. 4 is a plan view of a top panel of a shipper/display, showing the apertures for receiving the mounting tabs of the header, of the embodiment of FIGS. 1-3.
Figure 6:
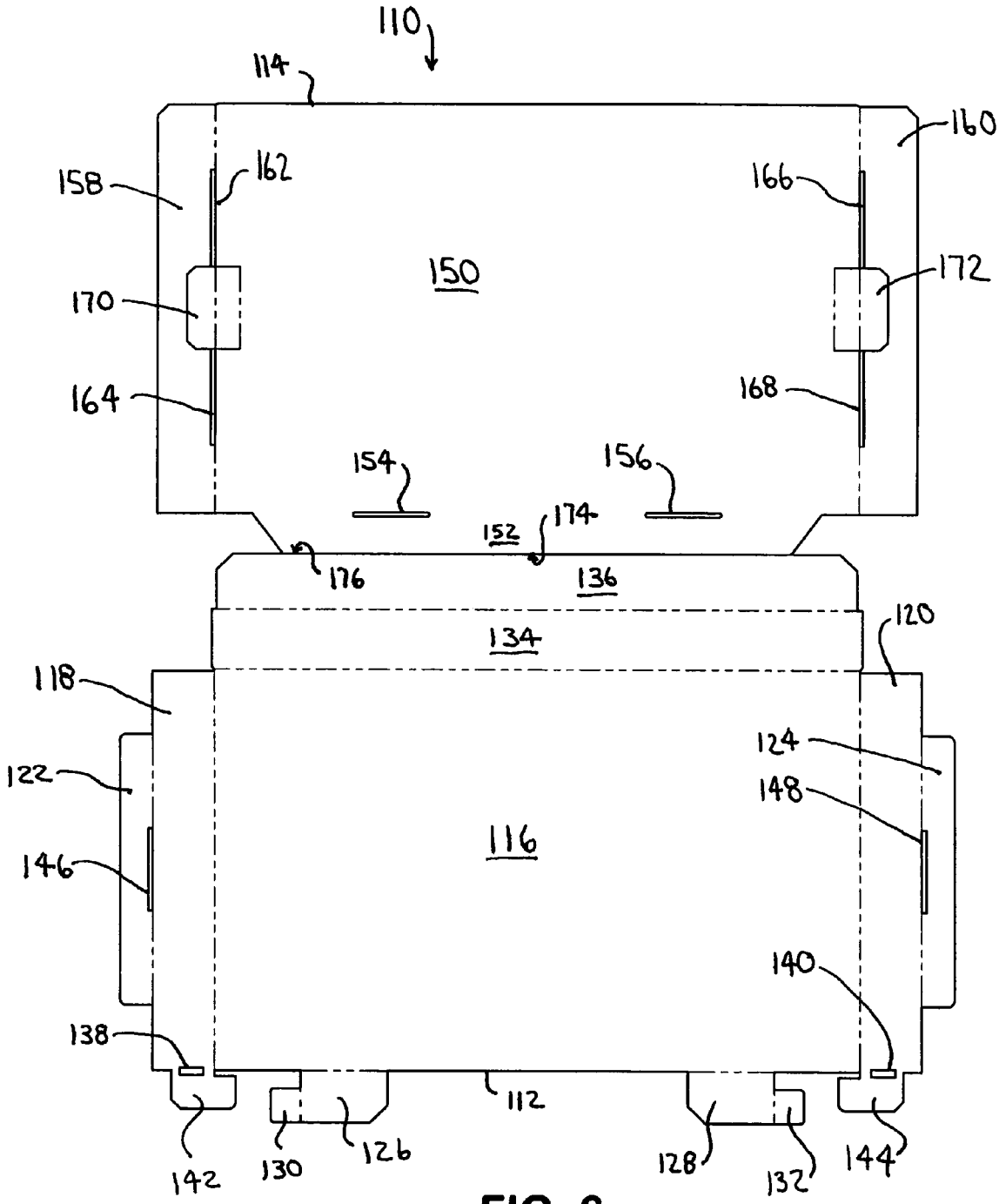
FIG. 6 is a plan view of a blank for a header according to a second preferred embodiment of the invention.

FIG. 4 illustrates a blank 50 for a display topper for a point-of-purchase display with which the header of FIGS. 1-3 may be used. In a preferred embodiment, display topper blank 50 preferably will have two portions that are folded over to provide a double-thickness structure; however, a single layer structure could be used, if desired. Display topper blank 50 includes upper panel 52, lower panel 54, rear flap 56, and side flaps 58, 60. Upper panel 52 includes tabbed slots 62, 64 and notched slots 66, 68. Lower panel 54 includes tabbed slots 70, 72, and rectangular slots 74, 76. In a preferred embodiment of the invention, panel 54 is folded under panel 52 (i.e., away from the observer of FIG. 4), and glued to the underside (far side) of panel 52. Flaps 56, 58 and 60 are then folded down (away from the observer) and inserted into upper wall gaps or slots, as may be appropriate, so as to position display topper 50 at an uppermost position on a display (not shown), preferably in a horizontal (or nearly so) orientation.

As disclosed in FIGS. 1-5, header 10 will be attached to display topper 50 in the following manner. Firstly, the side-to-side width of tabs 24, 26 (not including flaps 30, 32), is each slightly less than the length of notched slots 66, 68, respectively. Flaps 30, 32 are folded inwardly toward one another, and tabs 24, 26 are inserted into slots 66, 68, respectively, wherein the widened or notched portions of slots 66, 68, accommodate the increased thicknesses of tabs 24, 26, where flaps 30, 32 have been folded over. Once tabs 24, 26 have been fully inserted, and flaps 30, 32 have "cleared" (i.e., been pushed completely below) display topper 50, flaps 30, 32 are free to move back toward their unfolded positions. As such, tabs 24, 26 are captured by slots 66, 68, and cannot be removed without either deformation or the refolding of flaps 30, 32. In turn, header 10 becomes captured on display topper 50, and cannot easily become accidentally separated therefrom.

During loading and shipping of the display (not shown), header 10 remains essentially in the configuration shown in FIG. 2; that is, panels 18/16 and 22/20 remain parallel to panels 14/12. However, header 50 is laid down atop panel 52 of display topper 50, and within its "footprint" during shipment, after tabs 24, 26 have been inserted into slots 66/74 and 68/76. In order to maintain panel 12 in juxtaposed, parallel relation to panel 52 of display topper 50, tabs 24, 26 may be somewhat bent into an "S"-shape or similar distortion, but this should not adversely affect the subsequent performance of the header in its deployed configuration.

Once the point-of-purchase display has arrived at its commercial/retail destination, to deploy header 10, panels 16/18 and 20/22 are pivoted toward the rear of the display, to positions perpendicular to panels 12/14. See FIG. 5A. Once the side wall panels have been brought perpendicular to the center panels 12/14, header 10 is brought to a vertical position, with tabs 34/36 and 38/40 being inserted into aligned slots 62/70 and 64/72, respectively, with the beveled rearwardly facing edges of tabs 34/36 and 38/40 enabling clearance of the rearwardmost ends of the slots. Eventually, the tabbed portions of slots 62/70 and 64/72 will slip or snap into slots 34/44 and 46/48 of tabs 34/36 and 38/40, respectively, to retain header 10 in its fully deployed, erected configuration. See FIGS. 5B-5D.

The present invention also includes a box-shaped flip-up header construction, shown in FIGS. 6-10. Header 100 (in its assembled and/or articulated form in FIGS. 7-10) is formed from blank 110, which, in turn, is formed from a front portion 112 and a rear portion 114. Front portion 112 includes front panel 116, side panels 118 and 120, box-forming flaps 122 and 124, front panel tabs 126 and 128 with their corresponding locking flaps 130 and 132, lid panel 134 and closure flap 136. Side panels 118 and 120 include slots 138 and 140, and hooked tabs 142, 144. Slots 146 and 148 are positioned along the fold lines between side panels 118, 120 and their respective box-forming flaps 122, 124.

Rear portion 114 of blank 110 includes rear panel 150 with trapezoidal tab 152 and slots 154, 156; side panels 158 and 160; slots 162, 164, 166 and 168; and articulated tabs 170, 172. As blank 110 is laid out, the bottom edge 174 of trapezoidal tab 152 adjoins what becomes the free edge 176 of closure flap 136. At the same time as blank 110 is initially die cut from a web of material, preferably corrugated paperboard (or immediately thereafter), front portion 112 and rear portion 114 are cut, so as to separate from one another, along the common line between edges 174 and 176.

Figure 7:
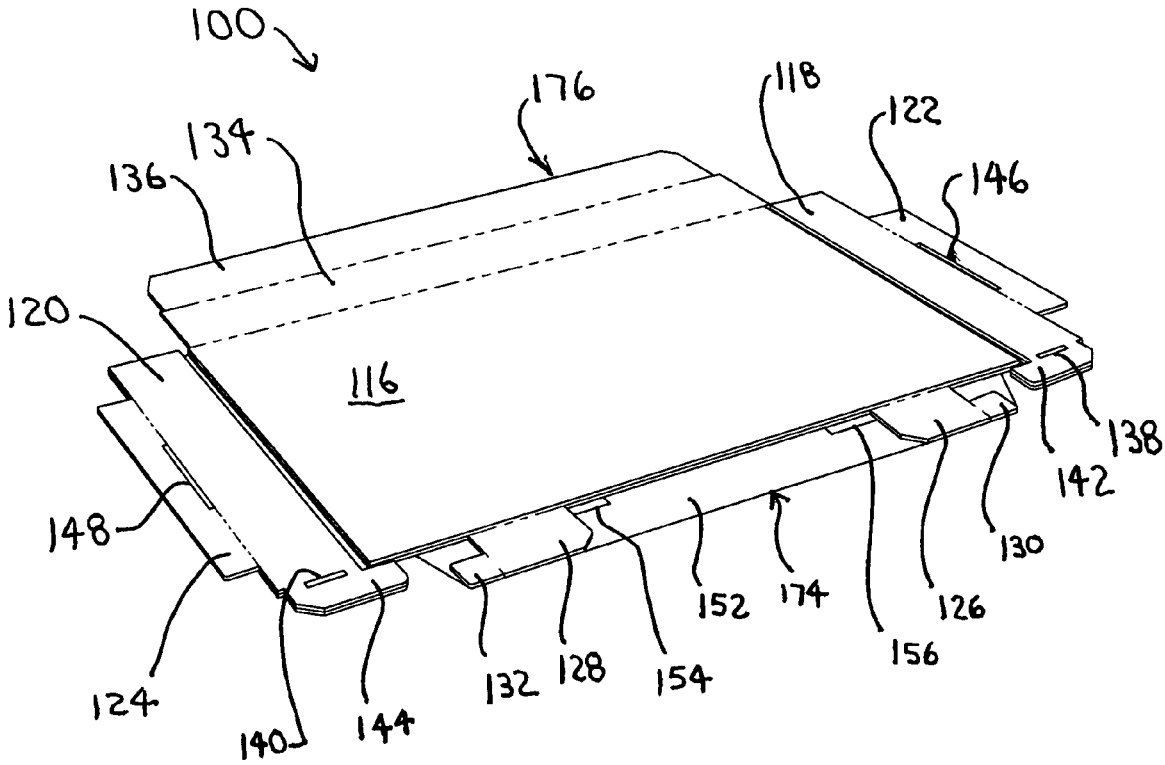
FIG. 7 is a perspective view of the header of FIG. 6, after severing the rear panel from the blank, and after initial articulation and gluing.
Figure 8:
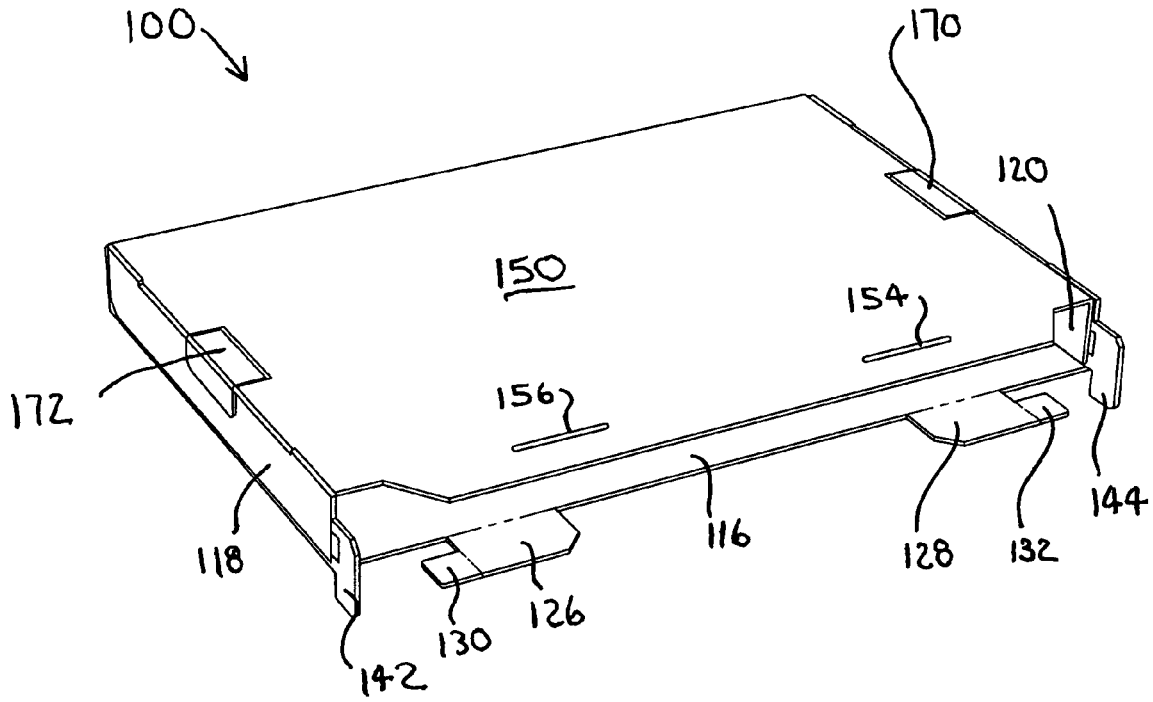
FIG. 8 is a perspective view of the header of FIGS. 6 and 7, after further articulation.
Figure 9:
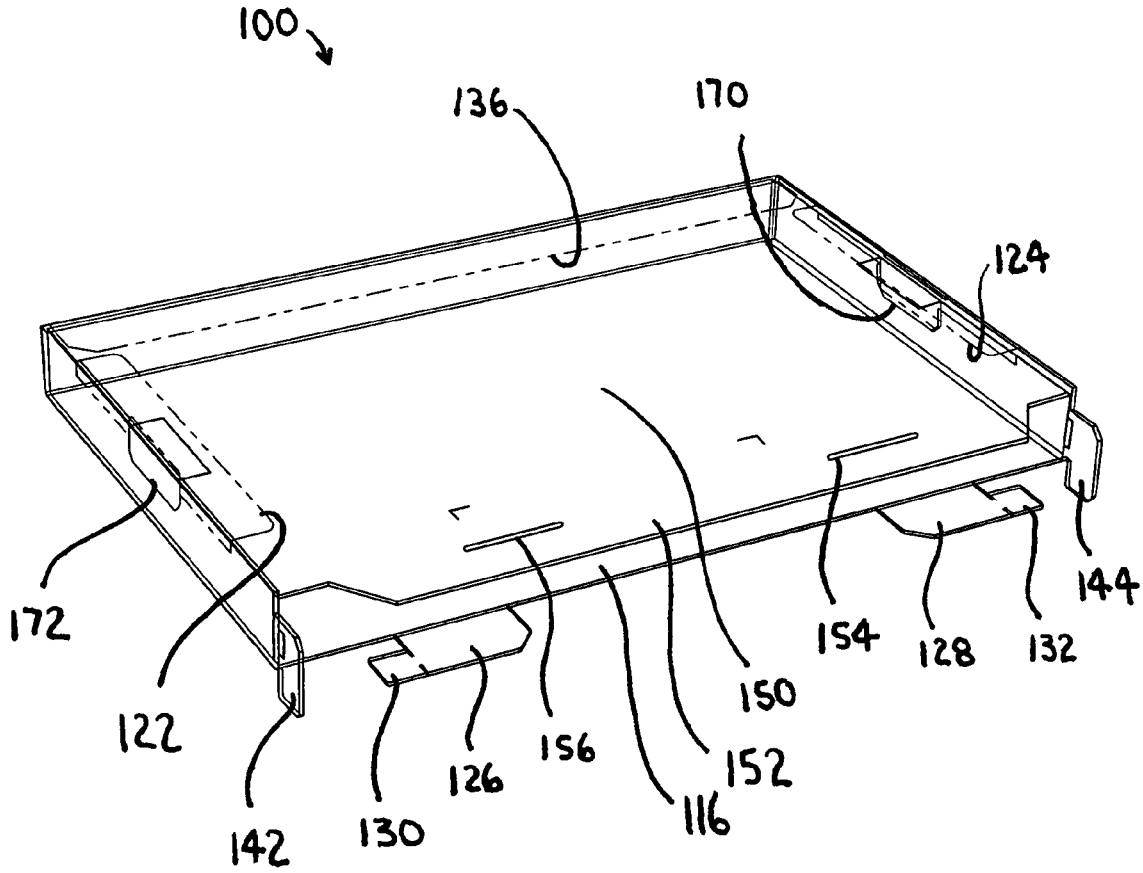
FIG. 9 is a view of the header of FIGS. 6 and 7, showing the placement of the various tabs and flaps, including those on the interior of the header, following articulation of the header into its box-configuration.

FIG. 7 illustrates how front portion 112 and rear portion 114 may be aligned with one another, prior to attachment to one another. To attach front portion 112 to rear portion 114, first side panels 118, 120 are folded perpendicular to front panel 116, and side panels 158, 160 are folded perpendicular to rear panel 150. Front panel 116 and rear panel 150 are arranged parallel to one another, and spaced apart by the width of side panels 158, 160, which are arranged to the outside of, and in juxtaposed parallel overlying relationship to, side panels 118, 120, so that box-forming flaps 122, 124 extend to the inside of, and generally parallel to, the inside surface of rear panel 150. Articulated tabs 170, 172 are then inserted into slots 148, 146. Lid panel 134 is folded perpendicular to rear panel 150, and closure flap 136 is tucked in to a position to the inside of rear panel 150. See FIGS. 8 and 9.

Figure 10:
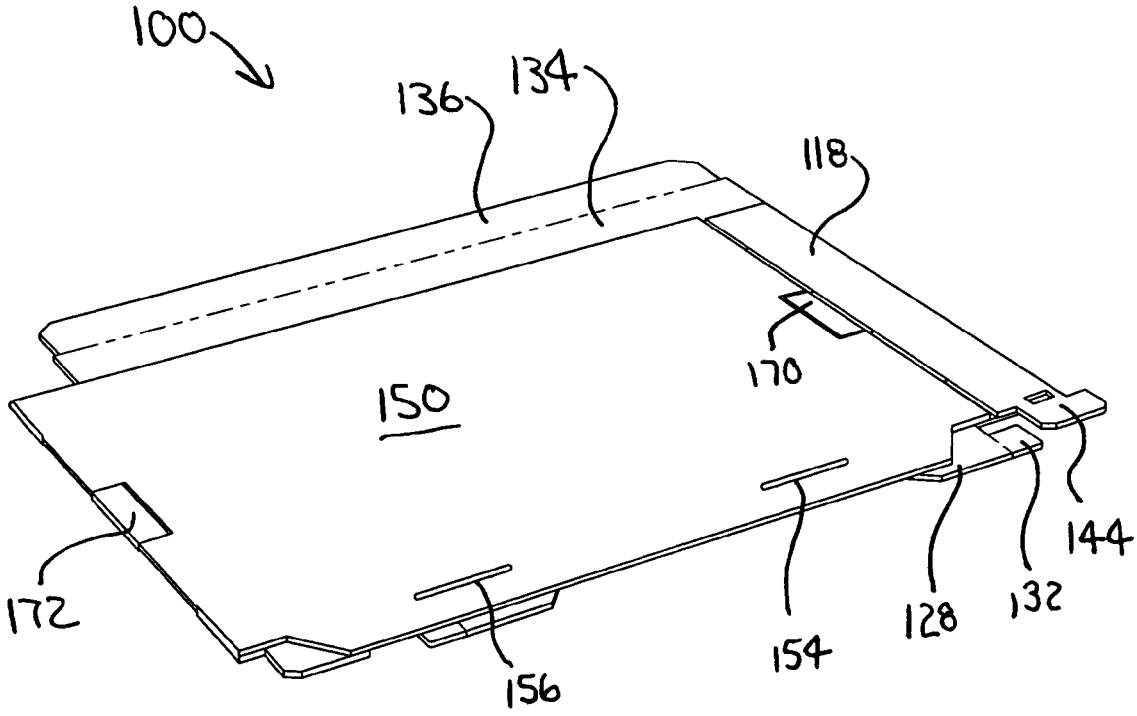
FIG. 10 is a perspective view of the header of FIGS. 6-9, after the front and rear portions of the header have been articulated and attached to one another, and then folded flat, as it would be positioned atop a display topper during shipment, prior to final articulation and rotation into its erected display orientation.

FIG. 10 illustrates how header 100 may be made to lie flat. Closure flap 136 is untucked and lid panel 134 is pivoted up to be parallel to rear panel 150. Then, the body of header 100 is parallelogrammed until front panel 116 and rear panel 150 are in contact with one another.

Mounting of header 100 on a display is similar to the manner in which header 10 is mounted onto topper 50 in the embodiment of FIGS. 1-5, except that a topper configured to work with header 100 will have, in addition to the slots shown in topper 50, one additional slot positioned toward the rear edge of the topper, to receive tab 152. This slot would also have two laterally extending tabs, configured to automatically snap into slots 124, 126, to further help stabilize and retain header 100 in position.

The foregoing description and drawings merely explain and illustrate the invention, and the invention is not so limited as those skilled in the art who have the disclosure before them will be able to make modifications and variations therein without departing from the scope of the invention.

The invention claimed is:

1. A display header, for a point-of-purchase display, comprising:

a central panel, for bearing display indicia;

at least one side panel, emanating from a first side edge of the central panel, for supporting the central panel;

the at least one side panel being pivotable from a position substantially adjacent to the central panel, to a position substantially perpendicular to the central panel;

at least one central panel tab, emanating from a lower edge of the central panel, and insertably and restrainably received in a first slot in a display topper of a point-of-purchase display, the at least one central panel tab enabling the central panel to be pivotable from a stowed position substantially parallel to an upper surface of the display topper of the point-of-purchase display, to a display position substantially perpendicular to the upper surface of the display topper of said point-of purchase display; and at least one side panel tab, emanating from a lower edge of the at least one side panel, and insertably and restrainably received in a second slot in the display topper of the point-of-purchase display, upon positioning of the at least one side panel in said position substantially perpendicular to the central panel, and upon positioning of the central panel in a position substantially perpendicular to the upper surface of the display topper of said point-of-purchase display.

2. The display header according to claim 1, wherein the central panel is disposed facing toward a front side of the point-of purchase display, with the at least one side panel extending rearwardly from the first side edge of the central panel, and wherein the display header is positioned along a rear edge region of the topper, and is operably configured to be folded downwardly, to a position overlying and adjacent to said upper surface of the topper, with no portions of the folded-down header extending beyond peripheral edge regions of the topper.

3. The display header according to claim 1, wherein the at least one side panel comprises two side panels, emanating from opposing side edges of the central panel, and pivotable from positions substantially parallel to the central panel, to positions substantially perpendicular to the central panel.

4. The display header according to claim 1, wherein the central panel comprises two central panel layers joined to one another along adjacent respective top edge regions of the two central panel layers, and folded to overlying positions parallel to and adhered to one another.

5. The display header according to claim 1, wherein the at least one side panel comprises two side panel layers joined to one another along adjacent respective top edge regions of the two side panel layers, and folded to overlying positions parallel to and adhered to one another.

6. The display header according to claim 1, wherein the at least one central panel tab has a width which is less than the length of the first slot in the display topper.

7. The display header according to claim 6, wherein the at least one central panel tab has a flap extending laterally therefrom, along a fold line, so that the total width of the at least one central panel tab and flap is greater than the length of the first slot in the display topper, so that upon folding of the flap back upon the at least one central panel tab, insertion of the at least one central panel tab into the first slot in the display topper is enabled, and after passage of the flap through the first slot, the tab is prompted to return toward an unfolded position, precluding removal of the at least one central panel tab from the first slot in the display topper.

8. The display header according to claim 1, wherein the at least one side panel tab has a width which is greater than the length of the second slot in the display topper, and includes a longitudinally forward-extending portion operably configured to be positioned, upon insertion of the at least one side panel tab into the second slot in the display topper.

9. The display header according to claim 8, wherein the at least one side panel tab includes a beveled rear edge to facilitate rotatable insertion of the at least one side panel tab into the second slot of the display header.

10. The display header according to claim 1, further comprising:

a longitudinally extending slot disposed between the at least one side panel and the at least one side panel tab, which is operably configured to receive a longitudinally extending and horizontally projecting tab disposed in the second slot in the display topper, for retaining the at least one side panel tab in its inserted position, to, in turn, retain the display header in its display position substantially perpendicular to the display topper.

11. The display header according to claim 3, further comprising:

a rear panel, operably and pivotably connecting the two side panels, and disposed parallel to the central panel, so that upon positioning of the display header in its stowed position, the rear panel is positioned parallel to and partially overlying the central panel, with one side panel extending parallel to and away from the central panel, and the other side panel overlying a portion of and extending parallel to the central panel, and upon positioning of the display header in its display position, the side panels are perpendicular to the central panel and the rear panel, and parallel to each other.

12. The display header according to claim 11, further comprising a lid panel pivotably connected, along a first edge thereof, to an upper edge of the central panel, between a stowed position, extending parallel to and away from the central panel, and a display position extending perpendicular to and toward the rear panel.

13. The display header according to claim 12, further comprising a closure flap extending from a second edge of the lid panel, and configured to be disposed adjacent an upper edge region of the rear panel, when the display header is in its display position, towards retaining the lid panel in its display position.

14. The display header according to claim 11, further comprising a rear panel tab, operably configured to be received in a third slot disposed in said display topper, for facilitating retention of the display header in its display position.

15. The display header according to claim 11, wherein the rear panel is connected to the side panels by interlocking slots and tabs disposed in the side panels and rear panel, respectively.

16. The display header according to claim 14, wherein the header, when erected is in the form of a box, which, when collapsed for shipping, has no portions of the collapsed down header extending beyond peripheral edge regions of the topper.

17. The display header according to claim 14, wherein the header is operably configured for articulation into a three-dimensional box shape upon deployment.

* * * * *